US006628275B2

(12) United States Patent
Vossen et al.

(10) Patent No.: US 6,628,275 B2
(45) Date of Patent: Sep. 30, 2003

(54) ENERGY RECOVERY IN A DRIVER CIRCUIT FOR A FLAT PANEL DISPLAY

(75) Inventors: Fransiscus Jacobus Vossen, Eindhoven (NL); Alphonsus Maria Van Amesfoort, Eindhoven (NL); Age Jochem Van Dalfsen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 225 days.

(21) Appl. No.: 09/854,397

(22) Filed: May 11, 2001

(65) Prior Publication Data

US 2002/0033806 A1 Mar. 21, 2002

(30) Foreign Application Priority Data

May 16, 2000 (EP) ..... 00201734

(51) Int. Cl.[7] ..... G09G 3/28
(52) U.S. Cl. ..... 345/211; 345/60
(58) Field of Search ..... 345/60, 61, 55, 345/58, 63, 66, 67, 68, 69, 204, 211; 315/169.1, 169.3, 169.4

(56) References Cited

U.S. PATENT DOCUMENTS 5,670,974 A * 9/1997 Ohba et al. ..... 345/60
6,496,166 B1 * 12/2002 Onozawa et al. ..... 345/60
6,538,627 B1 * 3/2003 Whang et al. ..... 345/60

* cited by examiner

*Primary Examiner*—Chanh Nguyen

(57) ABSTRACT

A full-bridge driver circuit comprising four controllable switches supplies a voltage having alternating polarities between a first and a second electrode of a flat panel display. A series arrangement of a capacitance present between the first and a second electrode, an inductor, and a diode, is arranged in parallel with one of the switches. The diode is poled to be conductive during a resonance phase. The control circuit closes one of the switches so that the inductor and the capacitance form a resonant circuit to reverse the polarity of the voltage in an energy-efficient way without requiring any other controllable switches than the ones forming the full-bridge driver circuit.

10 Claims, 4 Drawing Sheets

Sp 1

Sp 2

Sp 3

Sp 4

Figure 1:
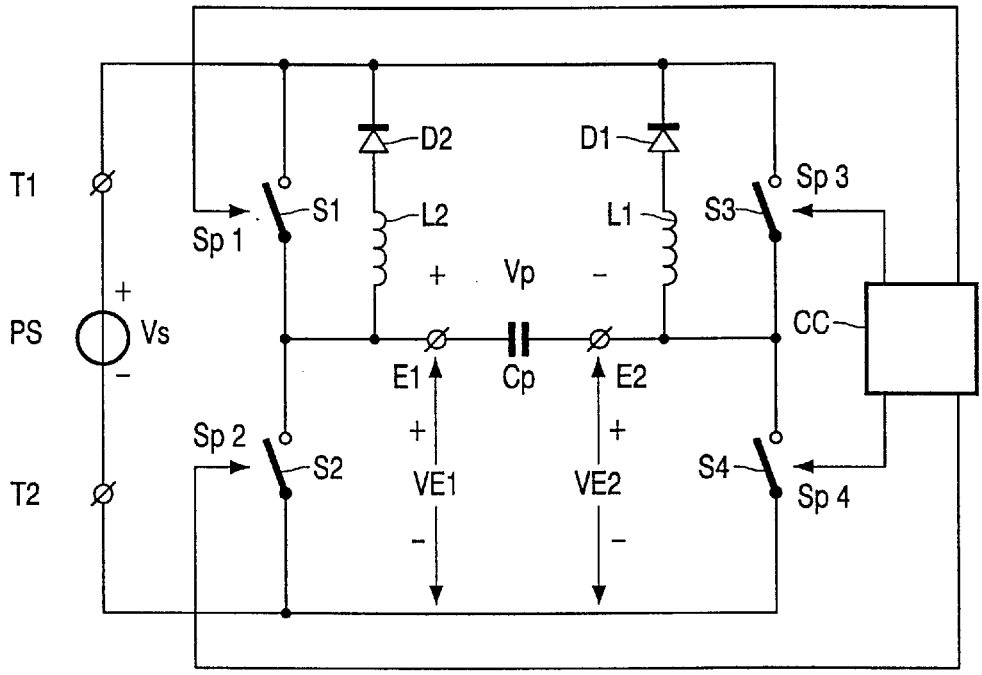

2Vs
Vs
VE 1
0

2Vs
Vs
VE 2
0

Vs
Vp
0
-Vs

P1
P3
P2
P4
t 1
t 2
t 3
t 4
t 5

ENERGY RECOVERY IN A DRIVER CIRCUIT FOR A FLAT PANEL DISPLAY

FIELD OF TECHNOLOGY

The invention relates to a driver circuit for supplying a voltage having alternating polarities between a first and a second electrode of a flat panel display, and a flat panel display apparatus comprising a flat panel display and such a driver circuit.

BACKGROUND AND SUMMARY

Alternating voltages are required between electrodes of flat panel displays like LCD's, Plasma Display Panels (PDP), Plasma Addressed Liquid Crystal displays (PALC), and Electro-Luminescent panels (EL). Due to a capacitance present between the electrodes, and required steep slopes of the alternating voltage, relatively large charge or discharge currents are required to reverse the polarity of the voltage across the capacitance. To minimize the power dissipation during the polarity reversion, driver circuits which comprise an energy recovery circuit in which an external inductance forms a resonant circuit with the capacitance are known from U.S. Pat. Nos. 5,081,400 and 5,670,974. Both these prior arts disclose an energy recovery circuit for a PDP.

A PDP may be driven in a sub-field mode wherein a plurality of successive sub-fields or frames occurs during a field or a frame of the video information to be displayed. A sub-field comprises an addressing phase and a sustaining phase. During the addressing phase, the plasma rows are selected one by one and data in conformance with the video information to be displayed is written into pixels of the selected row. During the sustaining phase, a number of sustain pulses is generated, dependent on the weight of the sub-field. Pixels pre-charged during the addressing phase to produce light during the sustaining phase will emit an amount of light during the sustaining phase which corresponds to the weight of the sub-field. The total amount of light produced by a pixel during the field or frame period of the video information depends, on the one hand, on weights of the sub-fields and, on the other hand, on those ones of the sub-fields during which the pixel was pre-charged to produce light.

In a PDP, the two electrodes may be the scan electrodes and the common electrodes. Cooperating scan electrodes and common electrodes form pairs which are each associated with one of the plasma channels. During the sustaining phase, the pairs of electrodes are driven with anti-phase square-wave voltages generated by a full-bridge circuit The full-bridge circuit comprises a first series arrangement of a first and a second controllable switch, and a second series arrangement of a third and a fourth controllable switch. A junction of main current paths of the first and the second switch is coupled to a scan electrode. A junction of main current paths of the third and the fourth switch is coupled to a common electrode. The first series arrangement and the second series arrangement are arranged in parallel across terminals of a power supply source. The main current path of the first switch is arranged between the scan electrode and a first one of said terminals, the main current path of the third switch is arranged between the common electrode and said first terminal. During a first phase of a sustaining period, two of the switches are open, whereas two of the other switches are closed, such that the power supply voltage supplied by the power supply source is available in a first polarity between the cooperating electrodes and thus across the capacitance. During a second phase of the sustaining period, the switches which were open during the first phase are now closed, and the switches which were closed are now open, such that the power supply voltage supplied by the power supply source is available in the reversed polarity between the cooperating electrodes.

U.S. Pat. No. 5,081,400 uses a large capacitor to store the recovered energy. U.S. Pat. No. 5,670,974 does not require such an extra energy storage capacitor. Both prior arts require further controllable switches in addition to the controllable switches of the full bridge.

It is, inter alia, an object of the invention to provide a driver circuit for a flat panel display, which driver circuit comprises a less complex energy recovery circuit.

To this end, a first aspect of the invention provides a driver circuit as claimed in claim 1. A second aspect of the invention provides a flat panel display apparatus as claimed in claim 8. Advantageous embodiments are defined in the dependent claims.

The driver circuit in accordance with the invention is able to provide energy recovery by adding, in series with the capacitance, a series arrangement of an inductor and a diode. The series arrangement of the capacitance, the inductor and the diode is arranged in parallel with the first switch of the full bridge. The diode is poled to be non-conductive during the first phase and the second phase wherein the four switches of the bridge are controlled by the control circuit to be on and off, such that the power supply voltage is available across the capacitance in the first and in the reversed polarity, respectively. The diode is conductive during a third phase which occurs in between the first and the second phase. In this third phase, wherein the control circuit closes the first switch, the series arrangement of the capacitance, the inductor and the diode forms a resonant circuit, and the voltage across the capacitance will change polarity in an energy-efficient way. The transfer from the first to the second phase is performed via the energy recovery during the third phase, only by controlling the already present switches of the full bridge. No additional controllable switches are required.

In an embodiment as defined in claim 2, a further series arrangement of an inductor and a diode is added to form a series arrangement of the capacitance, the inductor and the diode which is arranged in parallel with the third switch of the full bridge. Now, a fourth phase occuring after the second phase. In this fourth phase, the inductor of this further series arrangement forms a resonant circuit with the capacitance to allow an energy-efficient transfer from the reversed polarity to the first polarity of the voltage across the capacitance. Thus, when this embodiment of the invention is applied during a sustain period of a PDP, positive and negative voltage pulses are successively applied between cooperating scan and common electrodes. The energy recovery during the transition periods when the pulses change sign is obtained by controlling the switches of the full bridge in such a that way during these transition periods, the first-mentioned or the further series arrangements of the inductor and the diode form a resonant circuit with the capacitance.

In an embodiment as defined in claim 3, the second and the fourth controllable switches comprise an internal anti-parallel diode. For example, MOS transistors are controllable switches which have such internal diodes. The third and fourth diodes allow a negative voltage at the first and second electrodes.

In an embodiment as defined in claim 4, the third and fourth diodes allow a voltage at the first and second electrodes to have an absolute value exceeding the absolute value of the voltage supplied by the power supply source.

In an embodiment as defined in claim 5, parasitic currents are minimized. For example, a parasitic current will flow through a drain source capacitor of the fourth switch when the third switch is closed at the start of the resonance period. This current, which is supplied by a first terminal of the second capacitor, will flow via the fifth and the sixth inductor to the second junction which is the other terminal of the second capacitor. The series arrangement of the fifth and the sixth inductor forms a high impedance for this parasitic current. The main currents, which flow during the first and second phase and which are the plasma currents in a PDP, will not flow through the series arrangement of the fifth and the sixth inductor and will consequently not be negatively influenced by the presence of these inductors. A more detailed description of this feature is given with respect to FIG. 4.

In an embodiment as defined in claim 6, it is possible to supply a negative voltage to the electrode to which the series arrangement of the diode and the inductor is connected. If the series arrangement of the diode and the inductor is arranged between the capacitance and the negative terminal of the power supply source, a negative voltage on the electrode would be counteracted by the diode which would conduct.

In an embodiment as defined in claim 7, only a single inductor is required, but without additional components it is not possible to supply a negative voltage to the electrode to which the diodes are coupled via the inductor.

These and other aspects of the invention are apparent from and will be elucidated with reference to the embodiments described hereinafter.

BRIEF DESCRIPTION OF THE DRAWING FIGURES

Figure 3:
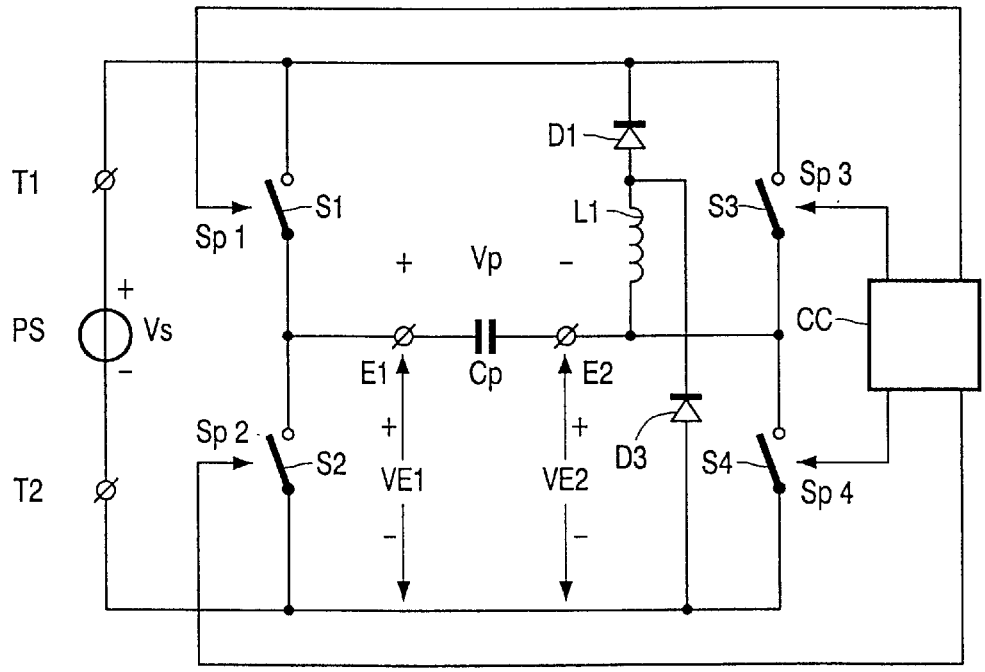
Figure 4:
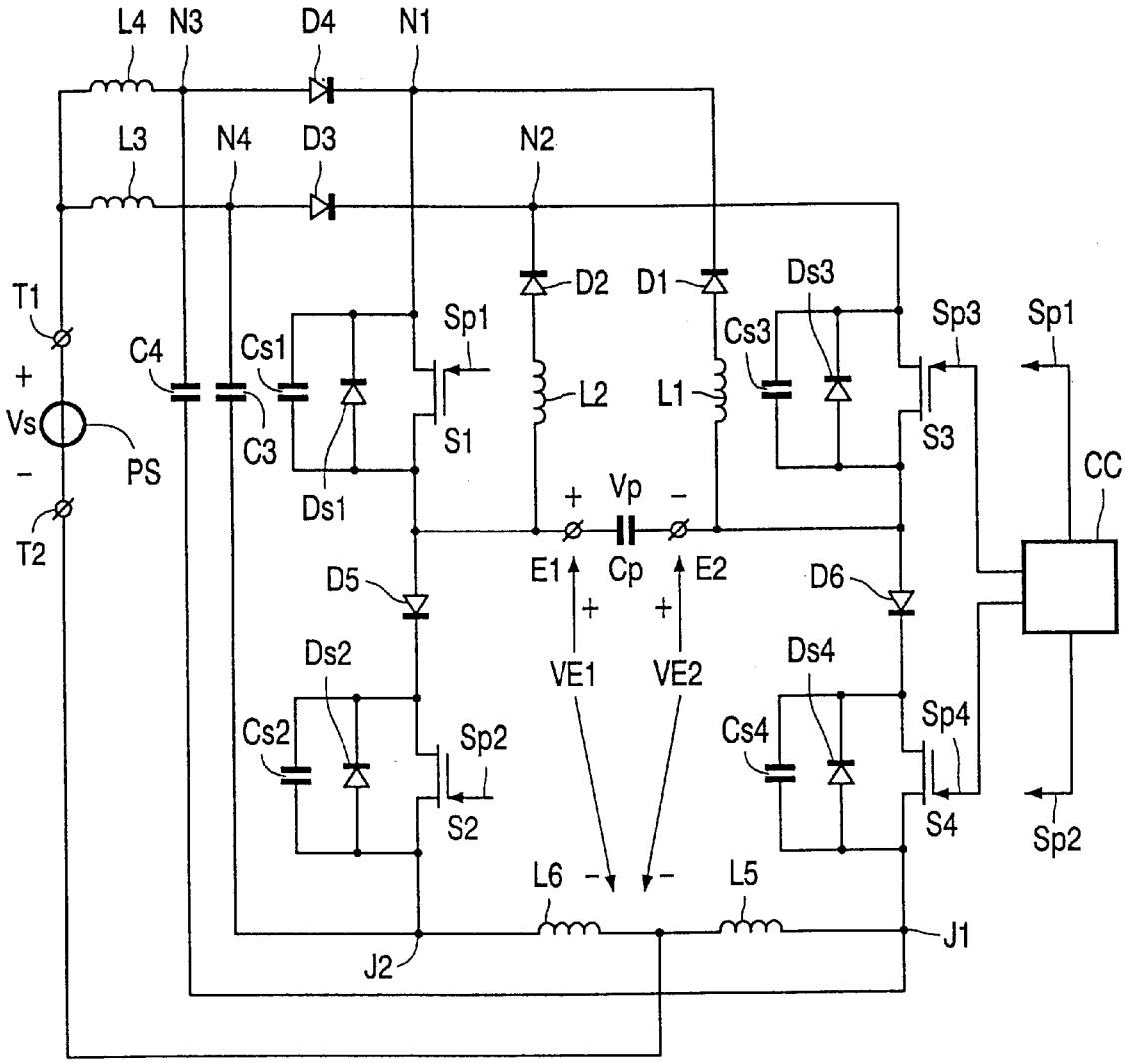
Figure 5:
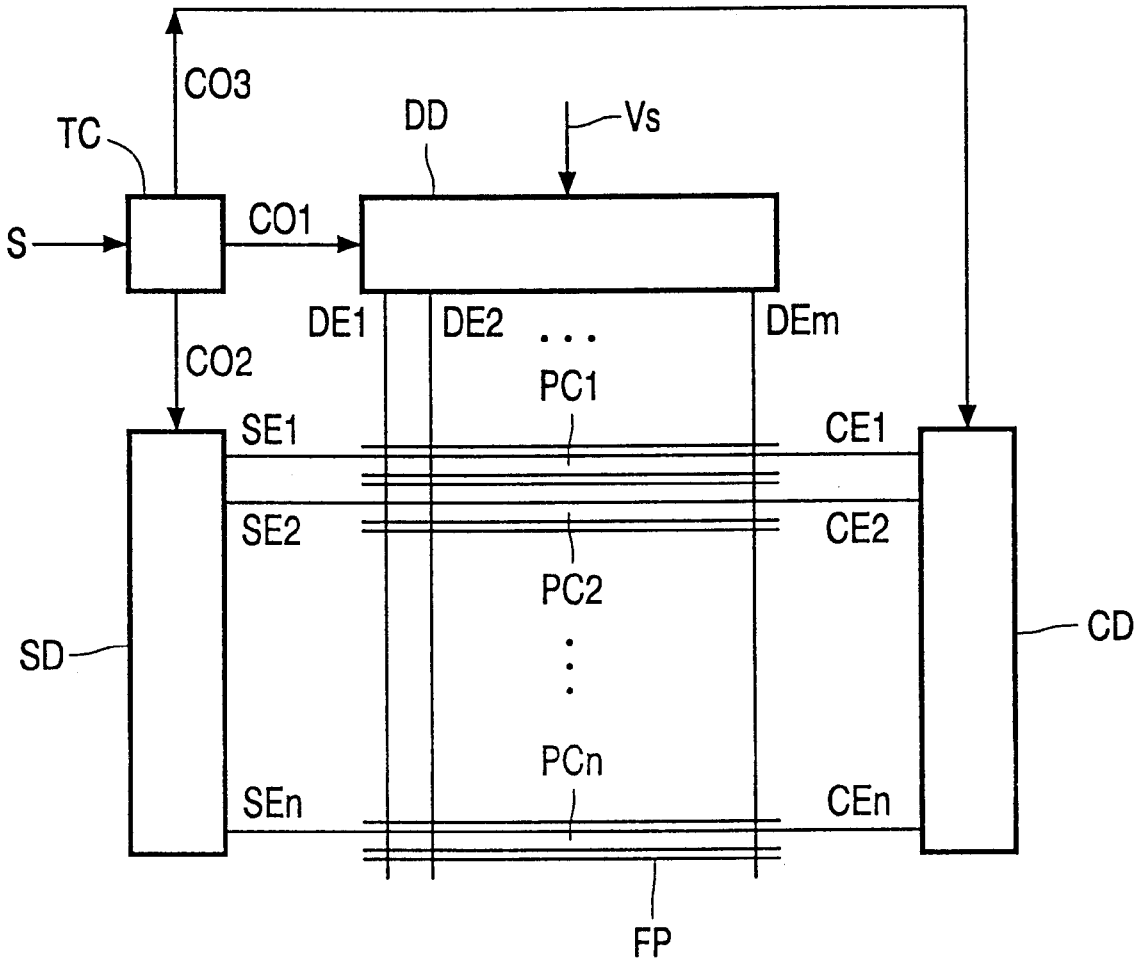

In the drawings:

FIG. 1 shows a circuit diagram of an embodiment in accordance with the invention, FIGS. 2A to 2G show waveforms of signals occurring in the circuit shown in FIG. 1, FIG. 3 shows a circuit diagram of an embodiment in accordance with the invention, FIG. 4 shows a circuit diagram of an embodiment in accordance with the invention, and FIG. 5 shows a flat panel display and a block diagram of driving circuits.

A power supply source PS has a first (positive) terminal T1 and a second (negative) terminal T2, and supplies a power supply voltage Vs.

DETAILED DESCRIPTION

A flat panel display has groups of cooperating electrodes associated with pixels which are arranged in a matrix. FIG. 1 shows, one group of cooperating electrodes. The group comprises the first electrode E1 and the second electrode E2. In a PDP, the first electrode E1 may be one of the scan electrodes SEi (see FIG. 5), and the second electrode E2 may be one of the common electrodes CEi. A pair of cooperating scan electrodes SEi and common electrodes CEi is associated with one of the plasma channels of the PDP. The first and second electrodes E1, E2 and the plasma channel form a capacitance which is represented by the capacitor Cp. If the flat panel display is an LCD, the first and the second electrode E1, E2 are the electrodes supplying the pixel voltage Vp across a pixel. The capacitor Cp represents the capacitance of these electrodes and the LCD pixel. VE1 denotes a voltage between the first electrode E1 and the second terminal T2, and is further referred to as the first voltage. VE2 denotes a voltage between the second electrode E2 and the second terminal T2, and is further referred to as the second voltage.

A main current path of the first controllable switch S1 is arranged between the first terminal T1 and the first electrode E1. A main current path of the second controllable switch S2 is arranged between the second terminal T2 and the first electrode E1. A main current path of the third controllable switch S3 is arranged between the first terminal Ti and the second electrode E2. A main current path of the fourth controllable switch S4 is arranged between the second terminal T2 and the second electrode E2. A control circuit CC supplies: a first switching signal Sp1 to a control input of the first switch S1, a second switching signal Sp2 to a control input of the second switch S2, a third switching signal Sp3 to a control input of the third switch S3 and a fourth switching signal Sp4 to a control input of the fourth switch S4.

A series arrangement of a first inductor L1 and a first diode D1 is arranged between the second electrode E2 and the first terminal T1. A series arrangement of a second inductor L2 and a second diode D2 is arranged between the first electrode E1 and the first terminal T1.

The operation of the circuit shown in FIG. 1 is elucidated with respect to FIG. 2. For simplification of the elucidation of the operation, and by way of example, the second terminal has ground potential.

Figures 2A, 2B, 2C, 2D, 2E, 2F, 2G:
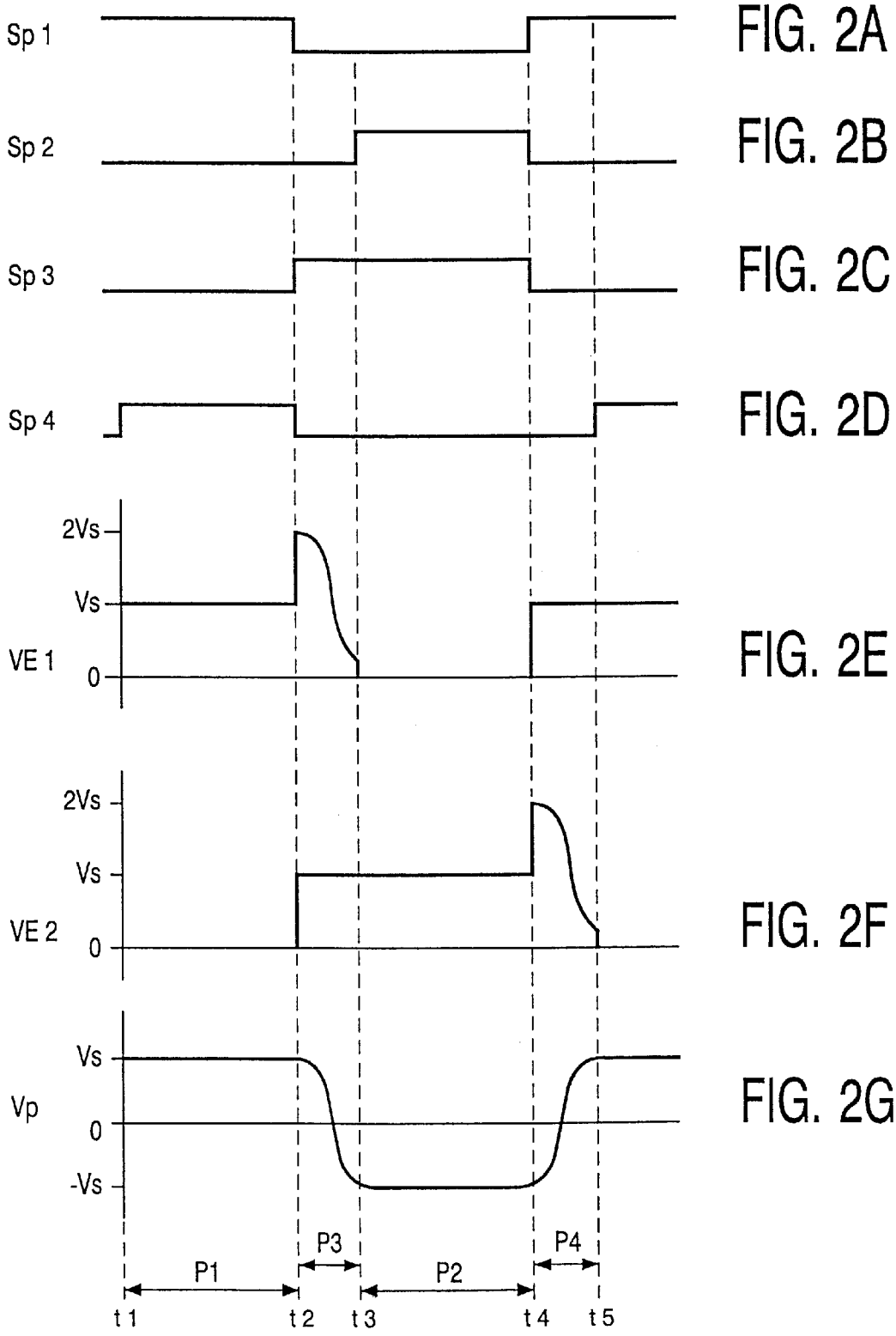

FIGS. 2A to 2G show waveforms of signals occurring in the circuit shown in FIG. 1. FIGS. 2A to 2D show the switching signals Sp1 to Sp4, respectively, by way of example, a high level indicates a closed switch, and a low level indicates an open switch. FIGS. 2E and 2F show the first and the second voltage VE1, VE2, respectively. FIG. 2G shows the pixel voltage Vp which equals the first voltage VE1 minus the second voltage VE2.

It is assumed that a first period of an alternating pulse starts at instant t1. Such a period comprises four phases: a first phase P1 wherein the pixel voltage Vp is positive, a second phase P2 wherein the pixel voltage Vp is negative, a third phase P3 wherein the pixel voltage Vp changes resonantly from the positive value to the negative value, and a fourth phase P4 wherein the pixel voltage Vp changes resonantly from the negative value to the positive value. Absolute values of both the positive and the negative value are substantially equal to the power supply voltage Vs minus voltage losses in the controllable switches. For ease of explanation, these voltage losses are neglected hereinafter.

During the first period P1 lasting from the instant t1 until the instant t2, the switches 2 and 3 are opened, and the switches 1 and 4 are closed. The first electrode E1 is connected to the first terminal T1, and the first voltage VE1 is equal to the power supply voltage Vs. The second electrode E2 is connected to the second terminal T2, and the second voltage VE2 is equal to zero. The pixel voltage Vp is positive.

At instant t2, the switches 1 and 4 are opened and the switch 3 is closed. The series arrangement of the pixel capacitance Cp, the second inductor L2, and the second diode D2 is short-circuited by the third switch S3 and forms a resonant circuit which will start resonating. At the instant when the switch S3 is closed, the second voltage VE2, which was zero, will jump to the value Vs equal to the power supply voltage Vs. Due to the capacitor Cp, the first voltage VE1 will jump by the same amount as the second voltage VE2, and thus change from the value Vs to the value 2 Vs which is two times the power supply voltage Vs. The resonance will stop at instant t3 when the current in the resonant circuit changes sign and the second diode D2 stops conducting. The voltage across the pixel capacitance Cp has reversed sign in an energy-efficient way. Due to losses in the resonant circuit, the first voltage VE1 will not become exactly zero at the instant t3.

At instant t3 (or somewhat later), switch S2 is closed. The first voltage VE1, which was already nearly zero, stays zero. The second voltage substantially keeps the value Vs. The voltage Vp keeps the value −Vs.

At the instant t4, the switches S2 and S3 are opened and the switch S1 is closed. The series arrangement of the pixel capacitance Cp, the first inductor L1, and the first diode D1 is short-circuited by the first switch S1 and forms a resonant circuit which will start resonating. The resonance will stop at instant t5 when the current in the resonant circuit changes sign and the first diode D1 stops conducting. The voltage across the pixel capacitance Cp has reversed sign in an energy-efficient way.

At instant t5, the next alternating pulse starts, which is obtained in the same way as the first alternating pulse which started at instant t1.

FIG. 3 shows a circuit diagram of an embodiment in accordance with the invention. Elements and signals denoted by the same references as in FIG. 1 have the same meaning and, if applicable, operate in the same way. The only difference is that the second inductor L2 and the second diode D2 are omitted, and that a diode D3 is added between the second terminal T2 and the junction of the first inductor L1 and the first diode D1. Again, the four phases occur in the order P1, P3, P2, P4. And again, the phases P3 and P4 are the resonant phases.

During the first phage P1, the circuit of FIG. 3 operate; in exactly the same way as the circuit of FIG. 1. The pixel voltage has the positive value Vs.

At the start of the third phase P3, the switches S1 and S4 are opened and the switch S2 is closed. A resonant current starts flowing in the resonant circuit formed by the pixel capacitance Cp, the switch S2, the diode D3, and the inductor L1. During the third phase P2, the first voltage VE1 is zero, the second voltage VE2 changes from the value −Vs to Vs, and the pixel voltage Vp changes from the value Vs to −Vs.

At the start of the second phase P2, the switch S3 is closed and the same situation is reached as during the second phase P2 of the circuit of FIG. 1. The pixel voltage has the negative value −Vs.

At the start of the fourth phase P4, the switches S2 and S3 are opened and the switch S2 is closed. A resonant current starts flowing in the resonant circuit formed by the pixel capacitance Cp, the switch S1, the diode D1, and the inductor L1. During the fourth phase P4, the first voltage VE1 has the value Vs, and the second voltage VE2 changes from the value 2 Vs to the value zero. Consequently, the pixel voltage Vp changes from the value −Vs to the value Vs.

FIG. 4 shows a circuit diagram of an embodiment in accordance with the invention. Elements and signals denoted by the same references as in FIG. 1 have the same meaning.

The power supply source PS has a first (positive) terminal T1 and a second (negative) terminal T2, and supplies a power supply voltage Vs.

A flat panel display has groups of cooperating electrodes associated with pixels which are arranged in a matrix. FIG. 4 shows one group of cooperating electrodes. The group comprises the first electrode E1 and the second electrode E2. A capacitance, which is represented by the capacitor Cp, is present between the first and second electrodes E1, E2. VE1 denotes a voltage between the first electrode E1 and the second terminal T2, and is further referred to as the first voltage. VE2 denotes a voltage between the second electrode E2 and the second terminal T2, and is further referred to as the second voltage.

A main current path of the first controllable switch S1 is arranged between a node N1 and the first electrode E1. A main current path of the second controllable switch S2 is arranged between a junction J2 and the first electrode E1. A main current path of the third controllable switch S3 is arranged between a node N2 and the second electrode E2. A main current path of the fourth controllable switch S4 is arranged between a junction J1 and the second electrode E2. Each switch S1 to S4 is a MOSFET with an internal anti-parallel diode Dsi and a drain-source capacitance Csi, wherein i is the number of the corresponding switch Si.

A series arrangement of an inductor L1 and a diode D1 is arranged between the second electrode E2 and the node N1. The cathode of the diode D1 is directed towards the node N1. A series arrangement of an inductor L2 and a diode D2 is arranged between the first electrode E1 and the node N2. The cathode of the diode D2 is directed towards the node N2. A diode D4 is arranged between the node N1 and a node N3, with its cathode directed toward; the node N1. A diode D3 is arranged between the node N2 and a node N4, with its cathode directed towards the node N2. An inductor L4 is arranged between the node N3 and the terminal T1. An inductor L3 is arranged between the node N4 and the terminal T1. A capacitor C4 is arranged between the node N3 and the junction J1. A capacitor C3 is arranged between the node N4 and the junction J2. An inductor L5 is arranged between the junction J1 and the terminal T2. An inductor L6 is arranged between the junction J2 and the terminal T2.

A control circuit CC supplies a first switching signal Sp1 to a control input of the first switch S1, a second switching signal Sp2 to a control input (Gate) of the second switch S2, a third switching signal Sp3 to a control input of the third switch S3 and a fourth switching signal Sp4 to a control input (Gate) of the fourth switch S4.

The switches S1 to S4 are controlled in the same way as in the circuit of FIG. 1. Also, the voltages VE1, VE2, and Vp are identical to the same voltages as shown in FIG. 2.

The diode D5 prevents the diode Ds2 from becoming conductive when the voltage on the electrode E1 becomes negative. The diode D6 prevents the diode Ds4 from becoming conductive when the voltage on the electrode E2 becomes negative. The diode D4 prevents the diode Ds1 from becoming conductive when the voltage on the electrode E1 becomes higher than the value Vs. The diode D3 prevents the diode Ds3 from becoming conductive when the voltage on the electrode E2 becomes higher than the value Vs. The diodes D3 to D6 are not required if the switches S1 to S4 do not have an internal anti-parallel diode, which is, for example, the case when bipolar transistors are used. Moreover, the diode D4 allows the voltage at the node N1 to peak to 2*Vs at the start of the phase P4. Without the diode D4, the voltage at the node N1 would be clamped at the value Vs. The same reasoning applies to the diode D3 with respect to the voltage at the node N2.

The different capacitors C3 and C4, and the inductors L5 and L6 are added to minimize capacitive currents flowing through the capacitors Cs1 to Cs4. This will now be elucidated for one situation. It is assumed that the circuit is in the first phase P1 (as is described with respect to FIG. 1) wherein switching S1 and S4 are closed, and the switches S2 and S3 are open. At the start of the resonant period P2, switches S1 and S4 are opened and switch S3 is closed at instant t2. At the instant when the switch S3 is closed, the second voltage VE2, which was zero, will jump to the value Vs equal to the power supply voltage Vs. Due to the capacitor Cp, the first voltage VE1 will jump by the same amount as the second voltage VE2, and thus change from the value Vs to the value 2 Vs. These voltage jumps cause parasitic capacitive currents through the capacitors Cs2 and Cs4. The capacitive current through the capacitor Cs4 is substantially supplied by the capacitor C3 via the diode D3 and the switch S3. This current has to flow back to the capacitor C3 via the inductors L5 and L6. The inductor L3 prevents the majority of this capacitive current from flowing via the power supply source PS. The inductors L3 to L6 have a value which is large enough to block most of the high-frequency capacitive currents, but low enough to allow recharging of the capacitors C3 and C4 without disturbing the currents supplied by these capacitors C3 and C4 during the first and the second phases P1 and P2 as these are described with respect to FIGS. 1 and 2. For example, during the first phase P1, the current flows from the capacitor C4 via the diode D4, the switch S1, the capacitance Cp, the diode D6, and the switch S4 back to the capacitor C4, without being disturbed by any of the inductors L3 to L6.

FIG. 5 shows a flat panel display and a block diagram of circuits driving the flat panel display. The flat panel display shown is a PDP of the kind in which the n plasma channels PC 1, . . . , PCn extend in the horizontal direction, and the m data electrodes DE1, . . . , DEm extend in the vertical direction. Intersections of the plasma channels PC1, . . . , PCn and the data electrodes DE1, . . . , DEm are associated with the pixels. A pair of cooperating select electrode SEi and common electrode CEi is associated with a corresponding one of the plasma channels PCi. A select driver SD supplies scan pulses to the n select electrodes SE1, . . . SEn. A common driver CD supplies common pulses to the n common electrodes CE1, . . . , CEn. A data driver DD receives a video signal Vs and supplies m data signals to the m data electrodes DE1, . . . , DEm. A timing circuit TC receives synchronization signals S belonging to the video signal Vs and supplies control signals Co1, Co2, and Co3 to the data driver DD, the select driver SD, and the common driver CD to control the timing of the pulses and signals supplied by these drivers.

During the addressing phase of the PDP, the plasma channels PC1, . . . , PCn are usually ignited one by one. An ignited plasma channel PCi has a low impedance. The data voltages on the data electrodes determine an amount of charge in each of the plasma volumes (the pixels) associated with the data electrodes and the low-impedance plasma channel PCi. A pixel preconditioned by this charge to produce light during the sustain period succeeding the addressing period will be lit during this sustain period. A plasma channel PCi which has a low impedance is further referred to as a selected line (of pixels). During the addressing phase, the data signals to be stored in the pixels of a selected line are supplied line by line by the data driver DD. During the sustaining phase, the select driver and the common driver supply select pulses and common pulses, respectively, to all the lines in which data has been stored during the preceding addressing phase. The pixels precharged to be lit will produce light whenever the associated plasma volumes are ignited. A plasma volume will be ignited when it is precharged to do so and the sustain voltage supplied across the plasma volume by the associated select electrode and common electrode changes by a sufficient amount. The number of ignitions determines the total amount of light produced by the pixel. In a practical implementation, the sustain voltage comprises pulses of alternating polarity. The voltage difference between the positive and the negative pulses is selected to ignite plasma volumes precharged to produce light, and not to ignite the plasma volumes precharged so as not to produce light.

The invention is particularly useful during the sustain period wherein many plasma volumes will be ignited at the same time. All these plasma volumes form a large capacitance between the select electrodes and the common electrodes. In practice this capacitance is even larger because these electrodes have a capacitive coupling with other parts of the flat panel display. In this situation, the capacitance Cp is formed by the capacitance mentioned in the previous sentence. The electrode E1 (of FIGS. 1, 3 and 4) is one or a group of the select electrodes, the electrode E2 is one or a group of the common electrodes. The switches S1 and S2 are part of the select driver, the switches S3 and S4 are part of the common driver.

Although FIG. 5 shows a special PDP, the invention is relevant to other PDP's. For example, the plasma channels may extend in the vertical direction, adjacent plasma channels may have an electrode in common. Or more generally, the invention is relevant to all flat panel displays wherein a voltage across a capacitance has to change polarity regularly, such as PDP's, LCD's, or EL displays.

It should be noted that the above-mentioned embodiments illustrate rather than limit the invention, and that those skilled in the art will be able to design many alternative embodiments without departing from the scope of the appended claims. For example, in the circuit shown in FIG. 1, the series arrangement of the inductor L1 and the diode D1 may be arranged in parallel with the switch S2, and the series arrangement of the inductor L2 and the diode D2 may be arranged in parallel with the switch S4. The cathodes of the diodes D1 and D2 are poled towards the nodes E1 and E2, respectively.

In the claims, any reference signs placed between parentheses shall not be construed as limiting the claim. Use of the verb "to comprise" and its conjugations does not exclude the presence of elements or steps other than those stated in a claim. The invention can be implemented by means of hardware comprising several distinct elements, and by means of a suitably programmed computer. In the device claim enumerating several means, several of these means may be embodied by one and the same item of hardware.

What is claimed is:

1. A driver circuit for supplying a voltage having alternating polarities between a first and a second electrode of a flat panel display, the driver circuit comprising a first series arrangement of a first and a second controllable switch, a junction of main current paths of the first and the second switch being coupled to the first electrode, a second series arrangement of a third and a fourth controllable switch, a junction of main current paths of the third and the fourth switch being coupled to the second electrode, the first series arrangement and the second series arrangement both being arranged in parallel across terminals of a power supply source, the main current path of the first switch being arranged between the first electrode and a first one of said terminals, the main current path of the third switch being arranged between the second electrode and said first terminal, a first inductor, and a control circuit for controlling on and off-switching of said controllable switches to obtain a first phase, wherein said voltage has a predetermined polarity, and a second phase wherein said voltage has a reversed polarity, wherein in a third phase occurring in between the first and the second phase, the first inductor and a capacitance present between said electrodes form a resonant circuit to reverse said predetermined polarity in an energy-efficient way, wherein a series arrangement of the first inductor, the capacitance, and a first diode is arranged in parallel with the first switch, the first diode being poled to be non-conductive during the first and the second phase and to be conductive during the third phase, the control circuit being adapted to close the first switch during the third phase.

2. The driver circuit of claim 1, wherein the driver circuit comprises a second inductor and a second diode, a series arrangement of the second inductor, the second diode, and the capacitance being arranged in parallel with the third switch, the second diode being poled to be non-conductive during the first and the second phase and conductive during a fourth phase succeeding the second phase, the control circuit being adapted to close the third during the fourth phase.

3. The driver circuit of claim 2, wherein both the second and the fourth controllable switch comprise an internal anti-parallel diode, and in that the driver circuit further comprises a third diode being arranged in series with the main current path of said second switch, and a fourth diode being arranged in series with the main current path of said fourth switch, the third and the fourth diode being oppositely poled with respect to the respective corresponding anti-parallel diode.

4. The driver circuit of claim 2, wherein a third diode is arranged between the first terminal and the parallel arrangement of the first switch, on the one hand, and the series arrangement of the first inductor, the first diode, and the capacitance, on the other hand, the third diode having a first end coupled to the first terminal and being poled to allow an absolute value of a voltage at its other terminal to exceed an absolute value of a voltage at its first end, a fourth diode is arranged between the first terminal and the parallel arrangement of the third switch, on the one hand, and the series arrangement of the second inductor, the second diode, and the capacitance, on the other hand, the fourth diode having a first end coupled to the first terminal, and being poled to allow an absolute value of a voltage at its other terminal to exceed an absolute value of a voltage at its first end.

5. The driver circuit of claim 4, wherein the first end of the third diode is coupled to a first junction, via a first capacitor and to the first terminal of the power supply source via a third inductor, the first end of the fourth diode is coupled to a second junction via a second capacitor and to the first terminal via a fourth inductor, the main current path of the second switch is arranged between the first electrode and the first junction, the main current path of the fourth switch is arranged between the second electrode and the second junction, a fifth inductor is arranged between the first junction and a second one of the terminals of the power supply source, and a sixth inductor is arranged between the second junction and said second one of the terminals of the power supply source.

6. The driver circuit of claim 1 or 2, wherein said first terminal receives a positive potential from the power supply source.

7. The driver circuit of claim 1, wherein the driver circuit comprises a second diode coupled to a junction of the first diode and the first inductor, the second diode being poled in the same direction as the first diode, a series arrangement of the first diode and the second diode being arranged in parallel with the first series arrangement of the first and the second controllable switch.

8. A flat panel display apparatus comprising a flat panel display and a driver circuit for supplying a voltage having alternating polarities between a first and a second electrode of a flat panel display, the driver circuit comprising a first series arrangement of a first and a second controllable switch, a junction of main current paths of the first and the second switch being coupled to the first electrode, a second series arrangement of a third and a fourth controllable switch, a junction of main current paths of the third and the fourth switch being coupled to the second electrode, the first series arrangement and the second series arrangement both being arranged in parallel across terminals of a power supply source, the main current path of the first switch being arranged between the first electrode and a first one of said terminals, the train current path of the third switch being arranged between the second electrode and said first terminal, a first inductor, and a control circuit for controlling on and off-switching of said controllable switches to obtain a first phase, wherein said voltage has a predetermined polarity, and a second phase wherein said voltage has a reversed polarity, wherein in a third phase occurring in between the first and the second phase, the first inductor and a capacitance present between said electrodes form a resonant circuit to reverse said predetermined polarity in an energy-efficient way, wherein a series arrangement of the first inductor, the capacitance, and a first diode is arranged in parallel with the first switch, the first diode being poled to be non-conductive during the first and the second phase and conductive during the third phase, the control circuit being adapted to close the first switch during the third phase.

9. The flat panel display apparatus of claim 8, wherein the first electrode is a scan electrode, and the second electrode is a common electrode.

10. The flat panel display apparatus of claim 8, wherein the first, second, third, and fourth phases form a sustain period.

* * * * *